US005265717A

United States Patent [19]

Daghestani

[11] Patent Number: 5,265,717

[45] Date of Patent: Nov. 30, 1993

[54] CIGARETTE CASE FOR AUTOMATICALLY LIGHTING AND EJECTING A CIGARETTE CONTAINED THEREIN

[76] Inventor: Imad Daghestani, 1310 E. 89th St., Apt. 2W, Kansas City, Mo. 64131

[21] Appl. No.: 901,417

[22] Filed: Jun. 19, 1992

[51] Int. Cl.[5] ..... B65D 85/10; A24F 15/10

[52] U.S. Cl. ..... 206/88; 206/86; 206/250

[58] Field of Search ..... 206/85-89, 206/249-251, 257

[56] References Cited

U.S. PATENT DOCUMENTS

| | | | |
|---|---|---|---|
| 1,407,746 | 2/1922 | Hagarty | 206/249 |
| 1,821,753 | 9/1931 | Hovnan | 206/89 |
| 2,032,094 | 2/1936 | Le Voci | 206/88 X |
| 2,207,593 | 7/1940 | Lorant | 206/88 |
| 2,856,098 | 10/1958 | Geisel . | |
| 3,943,327 | 3/1976 | Vizelyi et al. . | |
| 4,342,902 | 8/1982 | Ping . | |
| 4,507,704 | 3/1985 | Chuang . | |
| 4,844,244 | 7/1989 | Mawby . | |

*Primary Examiner*—Bryon P. Gehman

*Attorney, Agent, or Firm*—Kokjer, Kircher, Bowman & Johnson

[57] ABSTRACT

A cigarette case having an arrangement for automatically lighting and ejecting a cigarette therefrom. The case includes an outer casing which receives the cigarettes therein. The cigarettes are loaded within a conveyor carousel which preferably has sufficient space to load an entire pack of cigarettes. An ejector lid is pivoted to the outer casing and provides an ejection opening for the lit cigarette when in the open position. Movement of the lid from the closed to the open position causes the conveyor carousel to advance one increment and places a cigarette on a lift device, which is raised to extend a portion of the cigarette out of the case such that it may be grasped by the user. During this lifting a lighter is activated to light the cigarette.

8 Claims, 2 Drawing Sheets

CIGARETTE CASE FOR AUTOMATICALLY LIGHTING AND EJECTING A CIGARETTE CONTAINED THEREIN

BACKGROUND OF THE INVENTION

1. Field of the Invention

The present invention relates in general to accessories for smoking tobacco. In particular, the present invention relates to an improved carrying case for cigarettes having means to light and eject a cigarette therefrom.

2. Description of the Related Art

One common problem with the smoking of cigarettes is the repetitive loss of a device to light the cigarettes. To overcome this problem several devices have been proposed which incorporate a lighter within a cigarette carrying case. Certain of these carrying cases include a combination lighter and ejector, such that the user may dispense a lighted cigarette directly from the carrying case. While certain of these devices have proved serviceable, they continue to have certain problems associated with their use, such as an inability to carry and automatically dispense a complete pack of twenty cigarettes, a dangerous lighter arrangement which does not adequately shield the flame of the lighter, and ejector means which do not maintain a stable hold upon the cigarette so that the lighted cigarette may easily be dropped.

SUMMARY OF THE INVENTION

An object of the present invention is to provide a cigarette carrying case having an arrangement for automatically lighting and ejecting a cigarette therefrom.

Another object of the present invention is to provide such a carrying case which may hold a complete pack of twenty cigarettes and automatically dispense such cigarettes without user intervention.

Another object of the present invention is to provide such a carrying case in which the lighter arrangement is well shielded for user safety.

Yet another object of the present invention is to provide such a carrying case which will eject a cigarette such that a portion of the cigarette is accessible to the user, but the remainder of the cigarette is enclosed within the case, such that it is securely retained.

These and other objects of the present invention are achieved by a cigarette case having an arrangement for automatically lighting and ejecting a cigarette therefrom. The case includes an outer casing which receives the cigarettes therein. The cigarettes are loaded within a conveyor carousel which preferably has sufficient space to load an entire pack of cigarettes. An ejector lid is pivoted to the outer casing and provides an ejection opening for the lit cigarette when in the open position. Movement of the lid from the closed to the open position causes the conveyor carousel to advance one increment and places a cigarette on a lift device, which is raised to extend a portion of the cigarette out of the case such that it may be grasped by the user. During this lifting a lighter is activated to light the cigarette.

BRIEF DESCRIPTION OF THE DRAWINGS

The objects and features of the invention noted above are explained in More detail with reference to the drawings in which like reference numerals denote like elements, and in which.

DETAILED DESCRIPTION OF THE INVENTION

Figure 1:
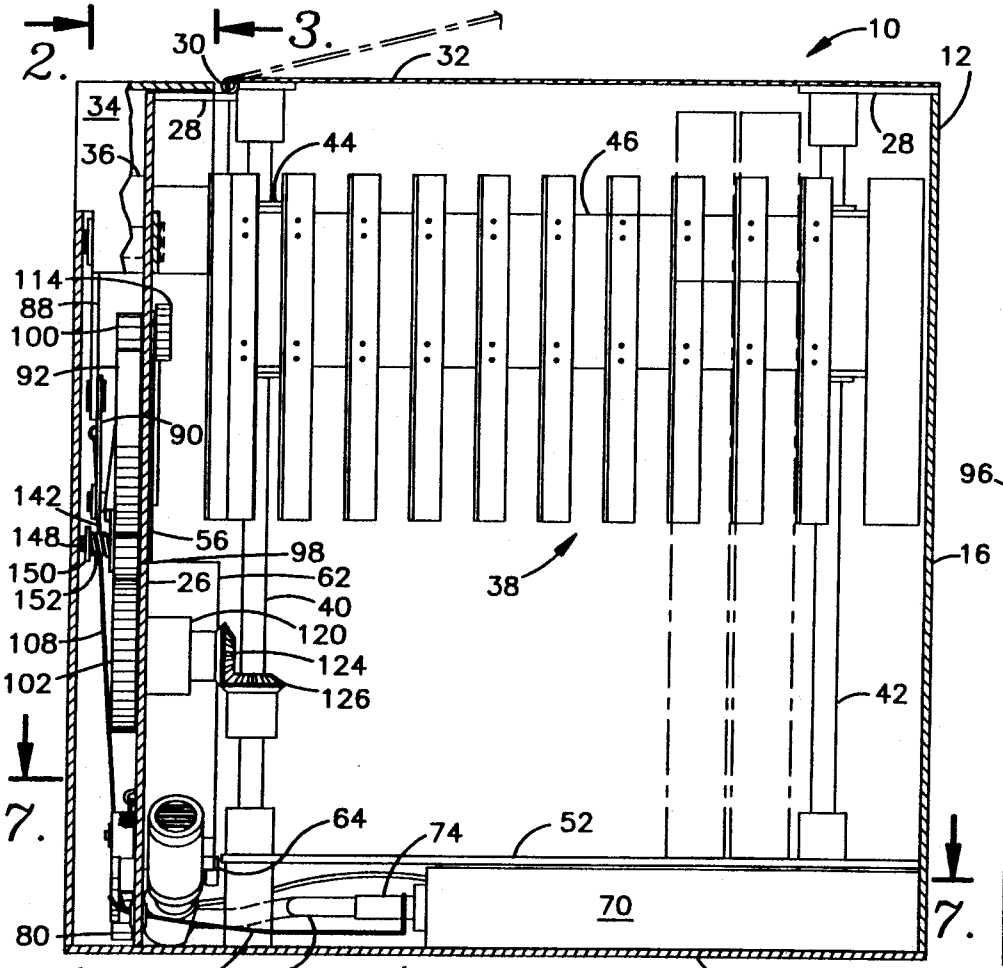
FIG. 1 is a cross-sectional from view of a device according to the present invention.

With reference to FIG. 1, a device according to the present invention is generally designated by reference numeral 10. Device 10 includes an outer casing 12 having the general form of a rectangular prism. The casing may be formed of various sufficiently rugged materials, such as aluminum.

Figures 4, 5, 6, 7, 8, 9:
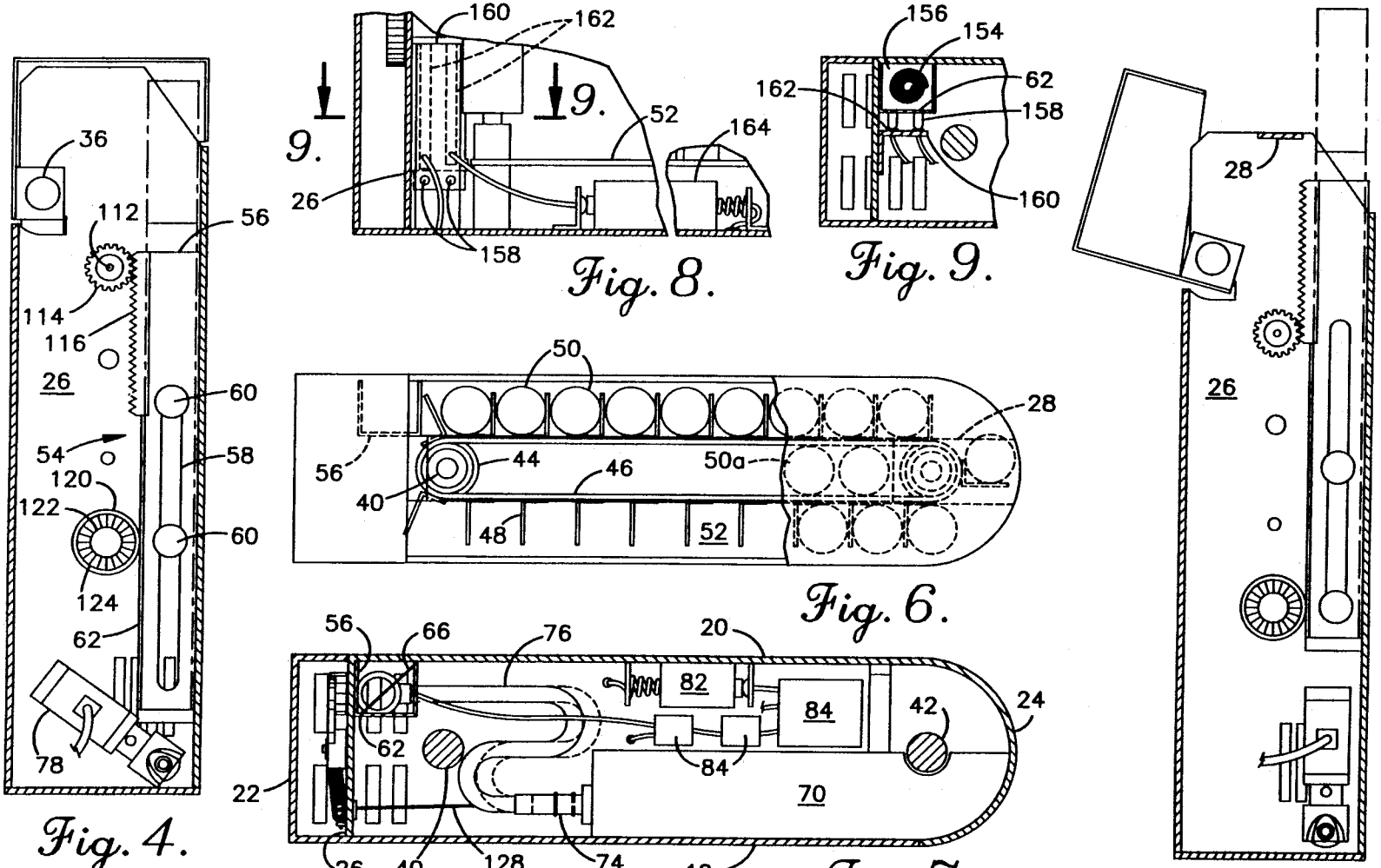
FIG. 4 is a cross-sectional right side view along line 4—4 of FIG. 1 showing the ejector lid in the closed position.
FIG. 5 is the view of FIG. 4 with the ejector lid in the open position.
FIG. 6 is a top view in partial cross-section showing the carousel for retaining the cigarettes.
FIG. 7 is a cross-sectional top view along line 7—7 of FIG. 1 showing a first embodiment of a lighter arrangement.
FIG. 8 is a partial front view in cross-section showing a second embodiment of a lighter arrangement according to the present invention.
FIG. 9 is a cross sectional view along line 9—9 of FIG. 8.

The casing generally consists of a bottom panel 14, having side walls 16 extending upwardly therefrom. As is best shown in FIG. 7, the side walls may include a front portion 18, a rear portion 20, a left side portion 22 and a right side portion 24. As is best shown in FIGS. 6 and 7, the right hand edge of the device 10 may be substantially rounded f or a purpose described below.

Spaced inwardly from the left portion 22 is a vertically extending gear support wall 26. Support wall 26 extends from the front portion to the rear portion, and is preferably rigidly fixed thereto as by welding. Extending laterally inward from each of the gear support wall 26 and right portion 24 is a frame extension 28. As is best shown in FIG. 6, the frame extensions have a depth substantially smaller than, preferably approximately one third, of the depth of device 10 and are centrally located in such dimension. Additionally, the extensions project laterally inward a relatively small distance, such the majority of the interior of device 10 is accessible from the top opening of side wall 16 about the frame extensions 28.

A lid hinge 30 is spaced laterally inward of the gear support wall 26 and mounts a lid 32 which extends from this hinge to the right portion 24 of the outer casing. The lid 32 is pivotable between an open position allowing access to the interior of the outer casing and a closed position with substantially seals the casing. Appropriate means (not shown) may be provided to releasably retain the lid 32 in the closed position.

To allow the interior of the outer casing to be fully closed there is provided an ejector lid 34. Ejector lid 34 is mounted to the gear support wall 26 by a laterally extending hinge pin 36 located in proximity to the front portion 18 of the side walls. At the very least the ejector lid extends laterally from the left portion 22 to a position adjacent the lid hinge 30. However, it is preferred that the hinge pin 36 be spaced downward from the upper ends of the sidewalls, and that the ejector lid 34 have side portions such that it forms a continuation of the left, front and rear portions. As may be seen from FIGS. 2–5, the ejector lid may rotate about hinge pin 36 between a closed position substantially sealing the outer casing 12 and an open position providing access to the interior of the casing, and in particular, access to the space bounded by gear support wall 26 and lid hinge 30 and rear portion 20 and frame extension 28.

Mounted within the space defined by the sidewalls and the gear support wall 26 is a conveyor or carousel 38. Carousel 38 includes first and second vertically extending axles 40 and 42 with these axles being rotatably mounted between associated frame extensions 28 and the bottom panel 14. Each of the axles is spaced inwardly of the adjacent lateral wall, and in particular the first axle 40 is spaced laterally inward of gear support wall 26, and second axle 42 is spaced inward of right portion 16.

Adjacent the upper end of each of the axles is mounted a friction cylinder 44. Friction cylinder 44 may take many forms, such as a cylinder of rubber or similar material having a high coefficient of friction. However, it is preferred that the friction cylinders be formed as metallic members having a plurality of radially extending splines.

Mounted about the friction cylinders 44 is an endless belt 46. The belt 46 is stretched taut between the friction cylinders, such that rotation of the axles, and thus the friction cylinders, will result in movement of belt 46. Where the friction cylinders are formed with splines, the interior face of the belt 46 may include appropriately spaced ribs to engaged with the splines to guard against slippage of the belt on the cylinders. The friction cylinders 44 may additionally include enlarged diameter end caps arranged vertically above and below the belt 46 to prevent vertical slippage of the belt.

Mounted upon the belt 46 at equal linear intervals are vertically elongated pushers 48. As is best shown in FIG. 6, the pushers are substantially L-shaped with a lower leg fixed to the belt 46 and the upper leg extending radially outward to a position in proximity to the surrounding sidewalls. The spacing of the pushers is slightly greater than the diameter of a standard cigarette 50, such that a cigarette may be vertically arranged between adjacent pushers 48. It is preferred that there be provided approximately 22 to 24 of the pushers 48, such that an entire standard pack of 20 cigarettes may be loaded within carousel 38 with certain of the spaces remaining empty.

As is best shown in FIG. 1, a support plate 52 is mounted within the casing at a position spaced above the bottom 14. In particular, the distance between the lid 32 and support plate 52 should be slightly greater than the length of cigarette intended to be use with the device 10. The support plate is substantially continuous and extends unbroken between the front and rear portions of the casing, and from the right portion of the casing to the laterally exterior edge of first axle 40. The support plate 52 will support the cigarettes 50 from below and allow the cigarettes 50 to be easily moved by the belt 46 about the carousel 38. Additionally, the slide plate 52 will support extra cigarettes which may be placed interior of the belt 46 as illustrated by go cigarettes 50(*a*) in FIG. 6.

The carousel 38 will serve to transport the cigarettes 50 in a counter clockwise direction as shown in FIG. 6, with each of the cigarettes sequentially being deposited upon an ejector generally designated by reference numeral 54. As is best shown in FIGS. 1 and 4–7, the ejector 54 includes a vertically extending slide plate 56 which is in abutment against the laterally interior face of gear support wall 26, adjacent the rear portion 20 of the casing. The slide plate 56 includes a vertically extending slot 58 which receives a pair of vertically spaced slide pins 60. The slide pins have enlarged heads which extend beyond the edges of slot 58, such that the slide pins maintain the slide plate 56 against the support wall 26, but allow vertical reciprocation along the wall.

As is best shown in FIGS. 4 and 5, the side of slide plate 56 spaced furthest from the rear portion of the casing includes a vertically extending abutment 62. The abutment 62 extends outward from the gear support wall 26 from the lower end to approximately the mid point of slide plate 56. As is best shown in FIGS. 4 and 7, a support bar extends normal to the abutment 62, and thus toward the rear portion of the casing, at the lower end of slide plate 56. As is best shown by comparison of FIGS. 1, 4 and 7, the support bar 64 extends f rom the abutment 62 vertical at a position such that the upper edge of the support bar is located at or below the level of support plate 52 when the slide plate 56 is in its lowered position of FIGS. 1 and 4. To complete the ejector 54 there is provided a support wire 66 (FIG. 7) which extends from the free end of support bar 64 to the intersection of the slide plate 56 and abutment 62, at the upper edge of support bar 64.

The next major element of the device 10 is a lighter generally designated by reference numeral 68. The lighter 68 includes a fuel tank 70 located between the bottom panel 14 and the support plate 52. As is best shown in FIG. 7, the fuel tank preferably comprises only approximately one-half of the depth of device 10 and substantially conforms to the interior of the device for increased storage capacity. The tank preferably will hold a gaseous combustion material such as propane, and may include an appropriate refill port (not shown). Adjacent the support wall 26 the fuel tank is provided with an outlet/valve combination 74 of the known type which is moveable inward and outward of the tank to respectively close and open the valve, with an internal biasing means to bias the outlet/valve inward to the closed position.

A flexible conduit 76 is operatively connected between the outlet/valve 74 and a burner unit 78. The burner unit is pivotally mounted to the support wall 26 by laterally extending burner pivot 80 located below the support bar 64 and slide plate 56, as best shown in FIG. 4. As such, the burner may pivot about the pivot 80 between an inoperative position shown in FIG. 4 and an operative position, wherein the upper, flame producing end is located below the support wire 66, as shown in FIGS. 5 and 7.

The lighter 68 further includes appropriate electrical components to ignite the combustible fluid contained in fuel tank 70 and conveyed to the burner unit via conduit 76. In particular, there may be provided an appropriate battery 82 which supplies electrical power to various electrical components 84 which may include transformers, capacitors, etc. The electrical components 84 are operatively connected a spark producing element of the burner unit which is fired by components 84 to ignite the fuel.

The final major element of the device 10 is control means for orchestrating the operation of the preceding components.

Figure 2:
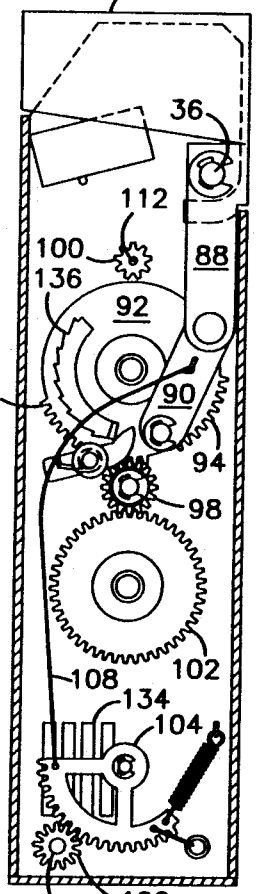
FIG. 2 is a cross-sectional left side view along line 2—2 of FIG. 1 showing the ejector lid in the closed position.

The control means includes a pivot bar 88 which is rigidly connected to ejector lid 34 and extends downward therefrom when the lid 34 is in the closed position. As is best shown in FIG. 1, bar 88 is located between the left portion 22 of the casing and the gear support wall 26 for a reason made clear below. It is also noted, as shown in FIG. 2, that when the ejector lid 34 is in the closed position the pivot bar 88 is adjacent the front portion of the casing. Abutment between the pivot bar and this portion of the casing may be employed to halt rotation of the ejector lid 34, which may include a spring to bias it towards the closed position.

Pivotally mounted to the free end of pivot bar 88 is a pivot link 90. In the closed position of the ejector lid 34 the pivot link 90 will extend substantially downward and slightly rearward of the device 10 to a lower end pivotally connected to a timing gear 92. The pivotal connection between link 90 and gear 92 is spaced from the pivotal connection of the timing gear 92 to the gear support wall 26. As such, rotation of the ejector lid 34 about hinge pin 36 will cause the free end of pivot bar 88 to move upward and rearward. As the link 90 is connected to the pivot bar, the link 90 will move upward and rearward, with the connection between the link 90 and timing gear 92 causing rotation of the timing gear. Specifically, movement of the ejector lid from the closed to the open position will cause counter clockwise movement of the timing gear 92, while opposite movement of the ejector lid will cause opposite rotation of the timing gear (all references to clockwise and counterclockwise are understood to refer to the figures showing the elements under discussion).

The outer periphery of timing gear 92 includes first and second spaced gear segments 94 and 96. The remainder of the outer periphery of gear 92 has a diameter substantially equal to the root diameter of the teeth contained in the gear segments. As is best shown in FIG. 2, when the ejector lid is in the closed position the first gear segment 94 will be located in a lower front quadrant of the gear 92, and not be engaged with compatible teeth. The second gear segment 96 will have a first end engaged with a transmission gear 98. While the first gear segment 94 is not engaged, and the second gear segment 96 is engaged in the closed ejector lid position shown in FIG. 2, comparison with FIG. 3 will show that the first gear segment 94 has engaged, and in fact moved from a first end of first gear segment 94 to a second end thereof, with a lift gear 100 pivoted to the support wall 26. In the same position of FIG. 3 the second gear segment 96 has passed from engagement near its first end through engagement at the second end to a position beyond the transmission gear 98, such that the transmission gear is located adjacent a non-toothed segment of the timing gear 92. As will become apparent from later discussion, the full angular extent of the geared segment of timing gear 92, i.e., from the first end of first gear segment 94 to the second end of gear segment 96, is slightly less than 180 degrees.

The fully toothed transmission gear 98 is located vertically below the timing gear 92, and located vertically below the transmission gear 98 is a conveyor gear 102 having a fully toothed periphery. As such, rotation of the transmission gear 98 due to engagement with the teeth of second gear segment 96 will cause rotation of conveyor gear 102. Similarly, rotation of the timing gear 92 through an arc beyond the second end of second gear segment 96 will not cause rotation of transmission gear 98, and thus not cause rotation of conveyor gear 102. As should be apparent to those skilled in the art, rotation of the ejector lid 34 from the open position of FIG. 3 to the closed position of FIG. 2 will have an opposite effect upon the timing, transmission, lift and conveyor gears.

Mounted vertically below the conveyor gear 102 is a primary burner gear 104. As with the other gears, this gear is mounted for rotation upon the support wall 26. Gear 104 includes appropriate teeth about its arcuate periphery, with these teeth being engaged with a secondary burner gear 106. Unlike the previous gears, the secondary burner gear 106 is offset from the vertical alignment as it is mounted upon the burner pivot 80, such that it rotates about an axis in proximity to the rear portion 20 of the casing, and substantially centered below the support wire 66.

While the primary burner gear 104 is intended to rotate about its axis in substantial synchronism with the remainder of the gears, it will become apparent from the discussion below that the burner gear 104 is preferably performed as an arcuate gear segment, rather than a full circumferential gear. The primary burner gear 104 is connected to the pivot link 90 via an at least substantially flaccid burner wire 108. The burner wire 108 includes a first end connected to the pivot link 90 at a position intermediate the ends thereof, and a second end fixed to a portion of the primary burner gear which is at least somewhat horizontally spaced from the pivot axis of such gear, such that vertical movement of the second end of the burner wire 108 will result in rotation of the primary burner gear 104, and thus the secondary burner gear 106.

Figure 3:
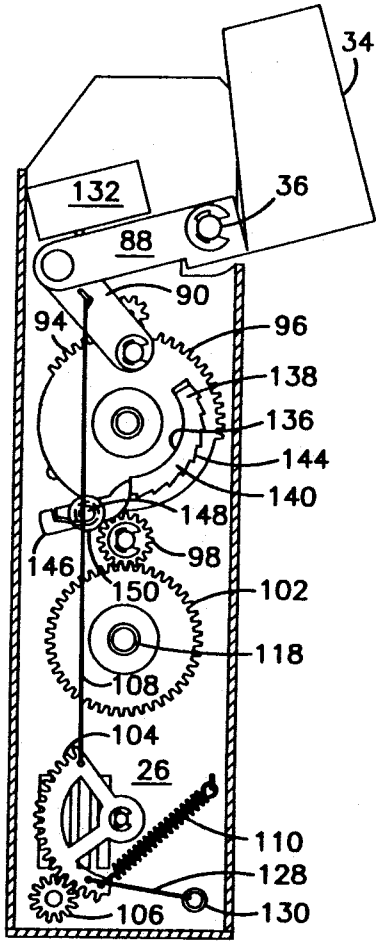
FIG. 3 is the view of FIG. 2 with the ejector lid in the open position.

The substantially flaccid nature of the burner wire 108, combined with the lack of toothed engagement between the primary burner gear and any other gear, precludes the possibility of the burner gear 104 returning from the position of FIG. 3 to the position of FIG. 2 unaided. As such, an end of the arcuate toothed segment of primary gear 104 mounts a burner return spring 110 having its other end fixed to the support wall 26. The return spring 110 will exert a biasing force upon the burner gear 104, returning it to its position of FIG. 3 f rom the position of FIG. 2. In a similar manner, this will return the secondary burner gear 106 from the position of FIG. 3 to the position of FIG. 2, due to the toothed engagement between these two gears.

While the above description details the physical placement of the gears, the connection of the gears, and thus the remainder of the control system, to the other main components of the device 10 will now be described With reference to FIGS. 1-5, the lift gear 100 is mounted for rotation upon the support wall 26 by a lift axle 112 which mounts upon its opposite end a lift pinion 114 having a toothed periphery. The exterior teeth on the lift pinion 114 are in engagement with a lift rack 116 fixed to the slide plate 56. As maybe envisioned, rotation of the lift gear 100 due to engagement with the first gear segment 94 will cause rotation of the lift axle 112 and thus lift pinion 114. This will in turn cause vertical movement of the lift rack 116, and thus the slide plate, support bar and support wire.

The conveyor gear 102 is rotatable mounted to the support wall 26 by a conveyor shaft 118 which extends through wall 26. On the side of support wall 26 opposite conveyor gear 102 there is fixed a clutch 120 which receives the conveyor shaft 118 at a first side thereof, and an output shaft 122 at a second end, with the output shaft extending towards the first axle 40. Mounted upon output shaft 122 is a drive bevel gear 124 which is in engagement with a driven bevel gear 126 mounted upon first axle 40.

The clutch 120 is a one way clutch such that counterclockwise rotation of conveyor gear 102 during opening of the ejector lid will be transmitted to a like rotation of drive bevel gear 124. This will in turn cause the axle 40, and thus second axle 42 and belt 46, to rotate. Clockwise movement of conveyor gear 102 during movement of the ejector lid from the open to the closed position is not transmitted, however, such that no movement of the belt 46 takes place during this action.

As noted above, the burner pivot 80 mounts the burner unit 78 and the secondary burner gear 106, such that rotation of the primary burner gear 104 during movement of the ejector lid will be transmitted to pivotal movement of the burner unit. Additionally, the primary burner gear 104 includes an at least substantially flaccid fuel supply wire 128 fixed thereto at a first end of the wire, with the wire extending through a wire opening 130 in the gear support wall 26. After passing through opening 130 the second end of supply wire 128 is fixed to the outlet/valve 74 of fuel tank 70. As is best shown with reference to FIGS. 2,3 and 7, when the primary burner gear 104 rotates from the position of FIG. 2 to the position of FIG. 3 the first end of supply wire 128 is carried with this gear, causing the second end of wire 128 to move towards the left portion of the casing, thus pulling the outlet/valve 74 outward of the fuel tank 70 to allow the fuel to pass through the flexible conduit 76 to the burner unit. As the outlet/valve 74 is biased towards the innermost position, movement of the primary burner gear 104 from the position of FIG. 3 to the position of FIG. 2 will result in the outlet/valve moving inward to cease the supply of fuel.

A final element of the control system of device 10 is a burner ignition switch 132 mounted adjacent the upper end of the gear support wall 26 at a position such that the pivot bar 88 may engage with the burner ignition switch to activate same when the ejector lid 34 has reached its fully open position. The ignition switch 132 is placed in an electrical circuit containing the battery 82, components 84 and ignition element of the burner unit, such that actuation of ignition switch 132 will cause the ignition unit of the burner to create a spark, thus igniting any fuel to the burner unit.

The operation of the device according to the present invention will now be described.

As an initial action, the user will raise the lid 32 from the top of the side walls to provide access to the interior of device 10. A plurality of cigarettes will be inserted into the device between pushers 48, with the filter end being uppermost. As may be apparent from review of FIG. 6, the lateral end positions of carousel 38 may be difficult to access due to the presence of ejector lid 34 and the right hand frame extension 28. It is for this reason that is preferred that slightly more than 20 cigarette locations are provided, such that an entire pack of cigarettes may be placed between the accessible ones of pushers 48 while leaving the laterally exterior, and inaccessible, positions empty. If desired, the user may at this point insert extra cigarettes in the space between the inner faces of the belt 46. Once the loading of the cigarettes has been completed the lid 32 is moved to its closed position and secured.

When the user desires a cigarette it is only necessary to move the ejector lid 34 from the normally closed position of FIG. 2 and 4 to the open position of FIGS. 3 and 5. During the movement of the ejector lid from the open to the closed position the pivot bar 88 will rotate in a clock wise direction, and due to the presence of pivot link 90 will cause the timing gear 92 to rotate counterclockwise. At the initial stage of rotation the first gear segment 94 has not yet attained engagement with lift gear 100 and as such the lift gear 100 is not initially rotated. However, the second gear segment 96 is initially in engagement with transmission gear 98, such that initial rotation of the timing gear will cause initial rotation of the transmission gear, and thus the conveyor gear 102. It is noted that during this initial rotation the burner wire 108 is moving from the position shown in FIG. 2 towards a taut position, but has not yet reached such a taut position.

The initial rotation of conveyor gear 102 will be counterclockwise, with this rotation being transmitted through the clutch 120 to the drive bevel gear 124. This will in turn cause counterclockwise rotation of first axle 40, as viewed in FIG. 6. The counterclockwise rotation of axle 40 will be transmitted through friction cylinder 44 to the belt 46 such that the entire belt 46 will rotate counterclockwise. This counterclockwise movement of belt 46 will move the cigarette 50 at the upper left of FIG. 6 towards the ejector 54, and with continued rotation of the ejector lid 34 the upper left cigarette of 56 will be moved by the associated pusher 48 to slide along the support plate 52, beyond support plate 52 and past support bar 64 to rest upon support wire 66.

The presence of abutment 62 prevents the travel of such cigarette about the axis of first axle 40, such that the abutment 62 acts as a guide f or movement of the cigarette caused by the pusher 48, to move the cigarette into the proper position upon the ejector 54. It is noted at this point that the lower end of the pushers 48 are located vertically above the upper end of abutment 62 when the ejector is in its lowermost position, as is the case here. This will allow the pusher 48 just prior to this cigarette to pass above the abutment and beyond due to rotation about axle 40, with the pusher 48 just subsequent to this cigarette taking the next forward position adjacent the ejector 54. As such, when the cigarette is moved upon the ejector 54 it is securely retained in its vertical position by the slide plate 56, abutment 62, rear portion of the casing and the pusher 48.

The angular extent of second gear segment 96 is sufficient such that a single increment of carousel 38 will be effected during its engagement with the transmission gear 98. As such, once the carousel has moved one incremental position forward to place a cigarette upon the ejector 54, the second gear segment 96 moves out of engagement with transmission gear 98. Further counterclockwise rotation of timing gear 92 will no longer result in continued rotation of the transmission gear 98 or conveyor gear 102. This ensures that no additional movement of the carousel will take place at this time.

Just subsequent to the gear segment 96 moving out of engagement with the transmission gear 98, the first gear segment 94 will come into engagement with lift gear 100, and burner wire 108 will attain its taut position. As such, continued rotation of the ejector lid towards its open positioned will result in the lift gear 100 being rotated in the clockwise direction with respect to FIG. 2, which will transmit this rotation to a counterclockwise rotation of lift pinion 114, as viewed in FIG. 4. This counterclockwise rotation of pinion 114 will result in the rack 116, and thus the ejector 54, moving upward with respect to the casing.

During this rotation of the pinion and lifting of the ejector, the primary burner gear 104 is undergoing clockwise rotation as viewed in FIG. 2 due to movement of the burner wire 108 upward. This clockwise rotation of gear 104 is transmitted to a counter clockwise rotation of secondary burner gear 106 and burner pivot 80. Additionally, the fuel supply wire 128 is being pulled outward of the opening 130, such that the outlet/valve 74 begins to move from its closed position to its opened position. The rotation of the burner pivot will tend to move the burner unit 78 clockwise as viewed in FIG. 4.

Continued rotation of the ejector lid towards its open position will cause continued upward movement of the ejector 54 and continued rotation of the burner unit to the upright position of FIG. 5, and continued outward movement of the outlet/valve 74. Just prior to the ejector lid reaching its fully opened position the outlet/valve will attain its open position and allow fuel to flow to the burner unit 78. A final incremental rotation of the ejector lid to its fully opened position will cause actuation of burner ignition switch 132, thus igniting burner unit 78.

The burner unit in this position is located directly below the ejector 54 carrying the cigarette 50. The lower most end of the cigarette 50 rests upon support wire 66 with no other structural components located intermediate the lower end of the cigarette and the burner unit. As such, the flame from the burner unit will extend upward and impinge upon the lower edge of the cigarette and support wire 66, resulting in the cigarette being lit. To aid in maintenance of the flame, there may be provided appropriate vent slots 134 in the support wall 26 and bottom panel 14, and possibly in certain of the side walls 16.

After the flame from the burner unit has impinged upon the cigarette for a short amount of time the user may readily grasp the filter end of the cigarette which has been raised above the level of lid 32, and preferably above the uppermost extent of ejector lid 34.

It is noted that during the upward movement of ejector 54 the support for the vertical orientation of cigarette 50 is never compromised, and the cigarette is still supported upon all four sides by the slide plate, abutment, rear portion and pusher when in the fully raised or ejected position of FIG. 5. As such there is less possibility that the user will inadvertently drop the cigarette from the device 10.

Once the user has removed the lit cigarette from the device 10, the ejector lid 34 is pivoted from the fully opened position of FIG. 3 to the closed position of FIG. 2. Initially, the counterclockwise rotation of the pivot bar 88 will allow the ejector to begin lowering due to engagement between the first gear segment 94 and lift gear 100, and allow the burner unit to pivot towards its inclined position of FIG. 4 due to the burner wire 108 moving downward and thus the primary burner gear pivoting counterclockwise. Most importantly, however, movement of the primary burner gear will allow the supply wire 128 to move inward of the opening 30 such that the outlet/valve 74 of fuel tank 70 is moved to its closed position, thus eliminating the flame from burner unit 78.

The remainder of the closing operation is substantially opposite to that during opening, with the one exception that the clutch 120 does not allow transmission of the rotation of conveyor gear 102 to the carousel 38. In this manner the carousel is maintained in its previous position and is not moved clockwise during closing of the ejector lid. This ensures that a new cigarette 50 will be located adjacent to the ejector 54 ready to be moved onto the ejector during the next opening of the ejector lid.

While the above arrangement is certainly operable, it is believed that in actual service the operation of the device may be improved by addition of means for requiring at least a substantially complete opening of the ejector lid 34. Specifically, the user may be tempted to open the ejector lid to a position intermediate the open and closed positions, and then move it back to the closed position out of curiosity or inadvertence. As is apparent from the discussion above, initial movement of the ejector lid from the closed position towards the open position results in rotation of conveyor gear 102 and advancement of the carousel 38. Movement of the lid from its opened position towards the closed position, however, does not result in opposite movement of the carousel.

As such, opening the ejector lid to a position intermediate the open and closed position and thereafter moving it to the closed position will result in a partial advancement of carousel 38, thus destroying the required placement of the pushers 48 at each advancement interval. Repeated partial openings of the ejector lid could result in a cigarette 50 being fully fed upon the ejector and the carousel 38 continuing to advance until the pusher 48 immediately behind the fed cigarette is abutted against such cigarette and placed in stress. This could cause damage to the device 10, and at the very least will result in faulty operation the next time the lid is moved from the fully closed to the fully opened position.

The means to require full opening of the ejector lid will element the possibility of partial opening and thus eliminate this problem. In the present invention this means takes the form of a mechanism which prevents closing of the lid until it has been moved to its fully opened position. In particular, a detent cam 136 is formed along an angular arc on the front face of timing gear 92. The detent cam has first and second ends 138 and 140 which have an angular extent approximately equal to the anticipated amount of rotation of timing gear 92 from the closed position of FIG. 2 to the opened position of FIG. 3. The first end 138 extends outwardly from the face of timing gear 92 to define an abutment face 142, while the second end 140 is substantially level with the outer face of gear 92. As such, the upper surface of the detail cam forms a transitional camming surface. The outer peripheral edge of the detente cam includes a plurality of teeth 144 for a purpose described below.

Adjacent the timing gear 92 and the first end 138 of the detente cam when the ejector lid is in the closed position of FIG. 2 is a spring pawl 146. Pawl 146 is mounted upon a post 148 fixed to the support wall 26 such that the pawl may rotate about the longitudinal axis of post 148. A cap 150 is located adjacent the free end of post 148 at a position spaced from the pawl 146. A spring 152 is connected to both the pawl 146 and the cap 150, such that the spring 152 biases the pawl both longitudinally towards the support wall 26 and angularly into engagement with the detente cam 136.

In operation, when the ejection lid is in the closed position the pawl will be biased into abutment with abutment face 142. As the ejector lid is rotated towards the open position the detente cam will rotate with timing gear 92, forcing the pawl to rotate clockwise while remaining in engagement with the peripheral teeth 144. As may be readily envisioned, if the ejector lid is at this point attempted to be returned to the closed position the pawl will engage with the teeth 144 to prevent clockwise movement of timing gear 92, and thus prevent closure of ejector lid 34. Only when the ejector lid has been moved to its open position does the second end 140 of the detente cam rotate past the spring pawl 146. At this point the spring 152 forces the spring pawl 146 to rotate counterclockwise such that it is located radially inward of the peripheral teeth 144.

Movement of the ejector lid from the open to the closed position will then cause clockwise rotation of timing gear 92. During this rotation the pawl 146 will slide upon the camming surface, thus allowing the ejector lid to be closed. When the ejector lid reaches the fully closed position the first end 138 of the detente cam will pass beyond the position of spring pawl 146, such that it is forced by spring 152 towards support wall 26 and into a position in, or to be placed into, abutment with abutment face 142. As may be readily seen, the elements 136–152 reliably ensure that the ejector lid is moved through its full range of movement to maintain the proper positioning of the carousel 38.

A second embodiment of the present invention is shown in FIGS. 8 and 9. In this second embodiment all elements of the device 10 are identical to that disclosed for the first embodiment, with the exception of the lighter and associated control mechanisms. In particular, in this embodiment the lighter is formed as an electrical resistance element rather than an actual flame producing burner.

This lighter includes a resistance coil 154 mounted upon an electrically insulating base 156, with the base 156 being carried within the lower section of the ejector 54. In particular, when the ejector lid is in the closed position, and the ejector therefore in its lowered position, the base 156 and coil 154 will be located vertically below the upper level of support plate 52.

The coil and base may be formed similar to that shown in U.S. Pat. No. 4,342,902 to Ping, and may therefore include a pair of contact pins 158 extending outward from the base 156 and abutment 62 towards the front portion 18 of the casing. Mounted upon the interior face of the support wall 26 is a contact wall 160 formed of a dielectric material and having a pair of vertically oriented, electrically conductive contact strips 162 mounted thereon. As is best shown in FIG. 9, the spacing of the contact pins and contact strips is substantially equal. The lighter is completed by an appropriate battery 164 operatively connected to the contact strips to provide current thereto.

As is best shown in FIG. 8, the contact strips 162 are vertically placed such that the lower ends are located vertically above the contact pins 158 when the ejector 54 is in the lowered position. However, when the ejector 54 is raised upward during opening of the ejector lid, the contact pins will make rubbing or sliding contact with the contact strips, thus completing the circuit with the battery 164 through the coil 154. This will cause the coil to heat, with the cigarette 50 resting upon the coil. This will thus light the cigarette in a manner similar to the first embodiment.

As this second embodiment relies solely upon the vertical movement of the ejector to activate the lighter, the various control elements for pivoting the burner and opening a valve may be eliminated. Specifically, the primary and secondary burner gears, the burner wire 108,, the burner return spring 110 and the fuel supply wire 128 may be eliminated. As these components were only connected to the remaining gear elements via burner wire 108, there is no effect upon the remaining gear elements from the removal of those listed elements.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A cigarette case, comprising:

an outer casing having a bottom and peripheral sidewalls extending upwardly therefrom, and therefore defining an interior cavity;

an ejector lid mounted to said casing for movement between an open position and a closed position;

a carousel conveyor mounted within said cavity and having an endless belt with a plurality of pushers mounted thereon, said pushers being spaced to allow a cigarette to be placed between adjacent ones of said pushers, and said conveyor including means permitting rotation of said belt;

an ejector mounted adjacent said conveyor within said cavity and being movable from a first position to receive a cigarette from said conveyor and a second position adapted to extend a portion of that cigarette to a position adjacent said ejector lid;

a lighter mounted within said cavity in proximity to said ejector; and control means, mounted to said casing, for advancing said conveyor to place a cigarette in said ejector, moving said ejector to said second position from said first position, and activating said lighter, all in response to said ejector lid moving from said closed position to said open position.

2. A case as in claim 1, wherein said ejector includes a slide plate mounted for sliding movement towards and away from said ejector lid, an abutment extending outwardly from said slide plate to a position within the outer periphery of the path of movement of said pushers, said abutment being located beyond the vertical extent of said pushers when said ejector is in said first position, and a base means mounted to said slide plate and adapted to support a cigarette from below.

3. A case as in claim 2, wherein said lighter includes a burner unit capable of producing a flame, and said base includes a support bar mounted to said slide bar in proximity to a lower end thereof, said slide plate, abutment and support bar defining a three-sided element having an opening in a substantially horizontal plane, and a support wire extending across said opening in said three-sided element and adapted to support a cigarette from below.

4. A case as in claim 3, wherein said burner unit is mounted in said cavity for pivotal movement between a first inoperative position at an angle with respect to vertical, and a second, substantially vertical, operative position.

5. A case as in claim 1, wherein said conveyor includes first and second laterally spaced axles, each having a friction member mounted thereon, and wherein said endless belt extends between and about said friction members, whereby rotation of said axles causes movement of said belt.

6. A case as in claim 5, wherein said pushers include outward free ends in proximity to interior faces of said sidewalls throughout a majority of the periphery of said belt.

7. A case as in claim 1, wherein said ejector lid is mounted for pivotal movement, said control means includes a plurality of gears mounted in said casing and at least capable of being placed in meshing engagement, and further includes a pivot bar mounted to said ejector lid and operatively connected to said plurality of gears, whereby movement of said lid causes movement of said plurality of gears.

8. A case as in claim 1, further comprising means requiring full movement of said ejector lid from said closed position to said open position prior to movement toward said closed position.

* * * * *